United States Patent [19]

Hoeger et al.

[11] 4,010,067

[45] Mar. 1, 1977

[54] PROCESS OF PREVENTING FORMATION OF RESINOUS DEPOSITS IN THE MANUFACTURE OF PAPER AND THE LIKE

[75] Inventors: Ernst Hoeger, Neuhofen; Margarete Scholl, Mannheim, both of Germany

[73] Assignee: Benckiser-Knapsack GmbH, Ladenburg (Neckar), Germany

[22] Filed: Feb. 21, 1975

[21] Appl. No.: 551,684

[30] Foreign Application Priority Data

Jan. 3, 1975 Germany ..... 2500209

[52] U.S. Cl. ..... 162/76; 162/80; 162/158; 162/181 R; 162/181 A; 162/DIG. 4

[51] Int. Cl.[2] ..... D21H 3/02

[58] Field of Search ..... 162/158, 76, 190, DIG. 4, 162/181 R, 181 A, 80; 210/54, 58; 252/DIG. 11, DIG. 17, 181

[56] References Cited

UNITED STATES PATENTS

| | | | |
|---|---|---|---|
| 3,234,124 | 2/1966 | Irani | 210/58 |
| 3,639,645 | 2/1972 | Miller et al. | 210/58 |
| 3,751,372 | 8/1973 | Zecher | 210/58 |
| 3,784,469 | 1/1974 | Krueger et al. | 210/58 |
| 3,804,770 | 4/1974 | Lorenc et al. | 210/58 |
| 3,832,393 | 8/1974 | Krueger | 210/58 |
| 3,832,396 | 8/1974 | Irani et al. | 260/545 P |
| 3,837,803 | 9/1974 | Carter et al. | 252/181 |
| 3,896,046 | 7/1975 | Carstens et al. | 162/DIG. 4 |

OTHER PUBLICATIONS

Tappi, vol. 47, No. 1, Jan. 1964, pp. 198A–201A.
Tappi, vol. 39, No. 10, Oct. 1956, pp. 684–690.

*Primary Examiner*—S. Leon Bashore
*Assistant Examiner*—William F. Smith
*Attorney, Agent, or Firm*—Erich M. H. Radde

[57] ABSTRACT

The difficulties encountered in the manufacture of paper, cardboard, and other cellulosic articles, as they are caused by the formation of resinous or pitch deposits on the paper as well as on the paper machines and processing apparatus, are overcome or at least considerably reduced, by the addition of phosphonic acids and more particularly of alkyl, amino or hydroxy alkyl, or cycloalkyl phosphonic acids or their alkali metal salts and of orthophosphoric acid or its alkali metal salts and/or of polyphosphoric acids. If required, amino polycarboxylic acids, hydroxy carboxylic acids, or their alkali metal salts, or alkali metal polyphosphates are also added during processing.

10 Claims, No Drawings

PROCESS OF PREVENTING FORMATION OF RESINOUS DEPOSITS IN THE MANUFACTURE OF PAPER AND THE LIKE

CROSS-REFERENCE TO RELATED APPLICATION

The present application Ser. No. 551,684 is related to the application of ERNST HOEGER and FRANZ BASKOVIC filed on February 21, 1975 and entitled PROCESS OF PREVENTING FORMATION OF RESINOUS DEPOSITS IN THE MANUFACTURE OF PAPER AND THE LIKE, AND COMPOSITION.

BACKGROUND OF THE INVENTION

1. Field of the Invention

The present invention relates to a composition useful for preventing formation of resinous or pitch deposits and more particularly to a composition for preventing formation and separation of resinous or pitch deposits in the manufacture of paper, cardboard, boxboard, and the like cellulosic material and to a process of preventing formation and separation of such resinous or pitch deposits.

2. DESCRIPTION OF THE PRIOR ART

The formation of resinous precipitates and deposition, i.e. of so-called pitch deposits presents a problem of considerable importance in the paper industry. These difficulties are caused by the presence of resins in the paper pulp or mechanical wood pulp and the like cellulosic materials. Resinous deposits originate also from residual sizing material which has not been completely utilized in paper sizing. The resinous materials coagulate and are deposited on and incrustate the pipelines and the walls of the stock preparation plants and vats and the screens, felts, presses, and drying cylinders of the paper machines Precipitation of the resinous material results in soiling and in rendering sticky the apparatus used, in inhibiting the removal of water from the cellulosic material, in the formation of stains and spots on the paper, and frequently in tearing and breaking of the paper and thus in faulty manufacture and defective final products and thus in production breakdown and losses.

Attempts have been made to overcome these difficulties by adding to the cellulose or paper pulp absorbents such as, for instance, kaolin or china clay. Addition of such absorbents decreases the stickiness of the precipitating resinous impurities. But such addition does not prevent separation and deposition of the resinous materials as such apart from the fact that addition of kaolin is undesired in the manufacture of many types of paper.

Furthermore, attempts have also been made to add to the paper pulp alkali metal polyphosphates, the solution of which had been adjusted to a pH-value between a pH of about 5.0 and about 8.0 in order to achieve the same results. Such addition is disclosed, for instance, in German Pat. No. 740,833.

Finally, it has been tried to overcome the difficulties caused by the precipitation of resinous materials by means of finely divided magnesium silicates.

All these additives, however, are capable to prevent resinous precipitates and deposits to a certain extent only. They fail to work especially if the manufacturing conditions are exceptionally difficult, for instance, if the water is of inferior quality, for instance, of a high degree of hardness, has a high content of polyvalent metal ions such as iron, manganese, and the like ions, or is contaminated by humic acids, or if the manufacture of paper, cardboard, and the like materials takes place at higher temperatures or at unusual pH ranges.

SUMMARY OF THE INVENTION

It is one object of the present invention to provide a simple and effective process of preventing formation and separation of such resinous precipitates and pitch deposits even uder extremely unfavorable manufacturing conditions.

Another object of the present invention is to provide a composition for carrying out said process.

Other objects of the present invention and advantageous features thereof will become apparent as the description proceeds.

In principle the process according to the present invention comprises the addition of phosphonic acids and preferably of phosphonic acids of Formula I:

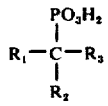

in which $R_1$ is hydrogen, lower alkyl such as $-CH_3$ or $-(CH_2)_n.CH_3$, the amino group $-NH_2$, hydroxy methyl $-CH_2OH$, a lower alkanoic acid group $-(CH_2)_n.COOH$, a lower alkyl phosphonic acid group $-(CH_2)_n-PO_3H_2$, or a group of the formula

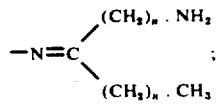

$R_2$ is hydrogen, hydroxyl $-OH$, the phosphonic acid group $-PO_3H_2$, a lower alkanoic acid group $-(CH_2)_n.COOH$, or a group of the formulas

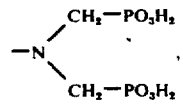

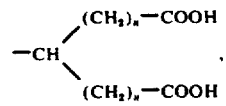

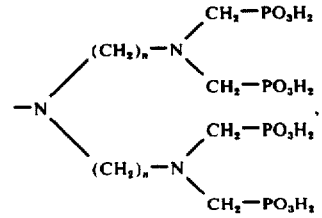

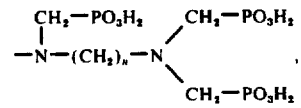

-continued

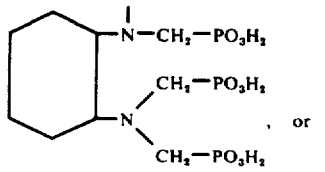

, or

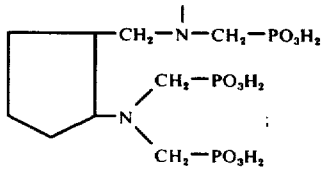

;

$R_3$ is hydrogen, hydroxyl —OH, the amino group $—NH_2$, lower alkyl such as $—CH_3$ or $—(CH_2)_n—CH_3$, a lower alkanoic acid group $—(CH_2)_n—COOH$, or the groups of the formulas $—NH—(CH_2)_n—PO_3H_2$ , $—NH—C_2—COOH$, or

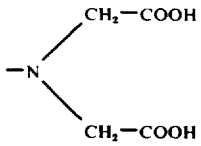

;

$n$ is one of the numerals 0 to 6, preferably 0 to 3. and of orthophosphoric acid, its alkali metal salts or polyphosphoric acids to the cellulose pulp, mechanical wood pulp, or ground wood during its processing.

The resinous deposit preventing power of the addition of phosphonic acids and of orthophosphoric acid and/or of its alkali metal salts, and/or of polyphosphoric acids is at least equal, and in many instances superior, to that of the phosphonic acids alone. Additionally there may be added amino polycarboxylic acids and/or hydroxy carboxylic acids or their alkali metal salts.

Useful phosphonic acids of the above given Formula I are, for instance, amino methane diphosphonic acid,
amino tris-methylene phosphonic acid,
diethylene triamino penta-methylene phosphonic acid,
propylene diamino tetra-methylene phosphonic acid,
ethylene diamino tetra-methylene phosphonic acid,
1,2-cyclohexane diamino tetra-methylene phosphonic acid,
1-amino methyl cyclopentyl amino(2)-tetra-methylene phosphonic acid,
N-phosphono methane-1-amino ethane-1,1-diphosphonic acid,
acetamidino ethane diphosphonic acid.

As compounds which are free of nitrogen there have proved to be especially effective 1-hydroxy ethane-1,1-diphosphonic acid and
1-hydroxy propane-1,1,3-triphosphonic acid.

Carboxy alkane amino alkane phosphonic acids such as bis-N-carboxy methane amino ethane diphosphonic acid or
phosphono butane tricarboxylic acid can also be used for the purpose of the present invention.

Best results are achieved by a combination of said phosphonic acids with acid or neutral salts of orthophosphoric acid. The mixing proportions may vary considerably. The preferred proportions of phosphonic acid to orthophosphoric acid are between about 10:1 and about 1:10. The most economical proportion of said active agents is about 1 part of phosphonic acid to about 4 parts of orthophosphoric acid, calculated for 100% orthophosphoric acid. It is, of course, also possible to use the active agents in other proportions and even in a proportion of about 4 parts of phosphonic acid to about 1 part of orthophosphoric acid if this is required under specific manufacturing conditions.

The preferred polyphosphoric acids to be added according to the present invention are those acids which correspond to the formula $$H_{n+2}P_nO_{3n+1}$$

in which formula n indicates a numeral between 2 and about 60. Compounds of this type are, for instance, disphosphoric acid, triphosphoric acid, tetraphosphoric acid, and medium to high molecular polyphosphoric acids and also the alkali metal salts thereof.

Useful hydroxy carboxylic acids which can additionally be employed in the process according to the present invention are, for instance, gluconic acid, citric acid, tartaric acid, lactic acid, and the like acids.

More particularly ethylene diamino tetra-acetic acid (EDTA), diethylene triamino penta-acetic acid (DTPA), and nitrilo-tri-acetic acid (NTA) have proved valuable polyamino carboxylic acids additionally to be used in the present process.

The effective agents, i.e. the phosphonic acids and orthophosphoric acid and/or polyphosphoric acid and/or the alkali metal orthophosphates can be added to the paper pulp to be processed either separately or in the form of a premanufactured mixture. The preventive agents can be added to any stage of processing the pulp. For instance, the agents can be admixed in the cellulose pulp manufacture to the cooking acid or liquor, to the chips, or during washing or refining, such as bleaching. The resinous deposit preventive agents can also be added during ground wood pulp manufacture to the grinding water or to the freshly prepared ground wood pulp (mechanical wood pulp).

When making paper, the preferred and most effective place of adding said agents is dependent on the place where the greatest separation and deposition of resin takes place. Usually the agents are added to the Hollander beater or the pulping apparatus. But addition can also be made to the pulp vat or to the flow box, i.e. the box supplying the stock material depending upon the manufacturing conditions.

The pH-value of the paper stock may be, for instance, at a constant pH between 4.5 and 8.0 Depending upon manufacturing conditions these values may also be higher or lower.

DESCRIPTION OF THE PREFERRED EMBODIMENTS.

The following examples serve to illustrate the present invention without, however, limiting the same thereto.

EXAMPLE 1 (Control)

The total resin content of a sulfite pulp known for its property of continuously causing difficulties on the paper machine due to resin deposition was determined by extraction with dichloro methane and was found to be 0.448%. The amount of harmful resin was 8.7% of the total resin content. This portion of the resin was determined by the following method:

100 g. of said sulfite pulp were beaten to a 4% suspension in water. The resulting stock suspension was caused to circulate in a laboratory Hollander beater without grinding for two hours. Working temperature: 40° C; pH-value of the suspension: 7.0. A previously cleaned sheet brass or brass plate was hung up into the circulating paper stock in order to collect the resin set free from the cellulose pulp. At the end of the experiment, the paper stock was drained from the laboratory Hollander beater and the beater and the sheet-brass were rinsed with water. The resin deposited on the walls of the Hollander beater and on the sheet-brass hung into the stock solution was collected by means of cellulose wadding moistened with dichloro methane and the wadding was extracted with dichloro methane. The sheet-brass was repeatedly rinsed with dichloro methane. The portions of dichloro methane obtained by the extraction and by rinsing were collected, evaporated to dryness, and the residual amount of resin was weight. 0.0391 g. of resin were found corresponding to 8.7%, calculated for the total resin.

EXAMPLE 2

The sulfite pulp used in Example 1 was processed in the same manner as described in said example. Before causing 100 g. thereof to circulate in the laboratory Hollander beater, 0.5% of a solution consisting of

- 4 parts of phosphoric acid in the form of a 75% phosphoric acid and
- 3 parts of ethylene diamino tetra-methylene phosphonic acid in the form of an 18% aqueous solution, said solution being adjusted to a pH of 7.0 by the addition of 50% sodium hydroxide solution, were added and the mixture was further processed as described in Example 1.

The amount of harmful resin was 0.015%, calculated for cellulose pulp, i.e. 3,35% of the total resin content.

EXAMPLE 3

This experiment was carried out in an analogous manner as described in the preceding Examples 1 and 2. 0.5% of a solution consisting of

- 23 parts of phosphoric acid in the form of a 75% phosphoric acid and
- 17 parts of diethylene tri-amino penta-methylene phosphonic acid in the form of a 37% aqueous solution, said solution being adjusted to a pH of 7.0 by the addition of 50% potassium hydroxide solution, were added before starting circulation of the pulp.

The amount of resin deposited during this experiment was 0.0112%, calculated for cellulose pulp charged, i.e. 2.5% of the total resin content.

The same or similar advantageous results were observed with other phosphonic acids, preferably alkyl phosphonic acids, amino alkyl phosphonic acids, hydroxy alkyl phosphonic acids, and especially and most advantageously those phosphonic acids as illustrated by Formula I given hereinabove when used in combination with orthophosphoric acid and/or polyphosphoric acids and/or their alkali metal salts.

It may be mentioned that, for instance, when operating at a higher pH-value, such as a pH of 9.0 to 9.5, the alkali metal salts and, under suitable conditions, the ammonium salts of the phosphonic acids can be added. Although the phosphonic acids as listed hereinabove, have proved to be especially useful for carrying out the present invention, there can be employed other phosphonic acids such as, for instance:

- Di-propylene triamino penta-methylene phosphonic acid,
- 1,2-bis-(amino methyl) cyclobutyl tetra-methylene phosphonic acid,
- 1,3-diamino-2-propanol tetra-methylene phosphonic acid and the like alkylene di- and polyamino polymethylene phosphonic acids,
- amino di-(methylene phosphonic acid),
- amino tris-(ethylidene phosphonic acid),
- amino tris-(isopropylidene phosphonic acid),
- diamino diethyl sulfido tetra-methylene phosphonic acid,
- 1-hydroxy ethane-1,1,2-triphosphonic acid, 1-amino ethane-1,1-diphosphonic acid and others.

The substantial reduction in resin or pitch deposition as shown in the preceding examples is usually sufficient to eliminate the difficulties caused by resin deposition in the manufacture of paper.

We claim:

1. In a process of preventing formation of resinous deposits and overcoming pitch trouble from a resin-containing cellulosic starting material in the manufacture of paper, cardboard, boxboard, and the like, said process comprising adding to the resin-containing cellulosic starting material during processing an additive consisting essentially of a phosphonic acid or an alkali metal salt thereof and orthophosphoric acid or an alkali metal salt thereof, said additive being added in an amount between about 0.02% and about 1.0%, calculated for dry cellulosic material in said starting material, and said phosphonic acid component and said orthophosphoric acid component being present in a ratio of from about 1:10 to 10:1.

2. The process of claim 1, in which the phosphonic acid added is a phosphonic acid of the formula

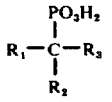

in which $R_1$ is hydrogen, lower alkyl such as $—CH_3$ or $—(CH_2)_n.CH_3$, the amino group $—NH_2$, hydroxy methyl $—CH_2OH$, a lower alkanoic acid group $—(CH_2)_n.COOH$, a lower alkyl phosphonic acid group $—(CH_2)_n—PO_3H_2$, or a group of the formula

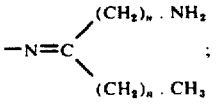

$R_2$ is hydrogen, hydroxyl —OH, the phosphonic acid group $—PO_3H_2$, a lower alkanoic acid group $—(CH_2)_n.COOH$, or a group of the formulas

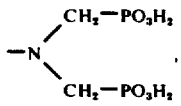

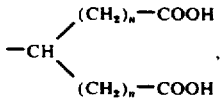

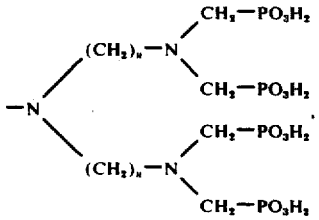

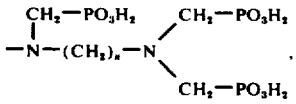

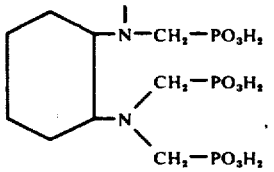

or

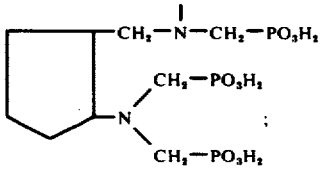

$R_3$ is hydrogen, hydroxyl —OH, the amino group $—NH_2$, lower alkyl such as $—CH_3$ or $—(CH_2)—CH_3$, a lower alkanoic acid group $—(CH_2)_n—COOH$, or the groups of the formulas $—NH—(CH_2)_n—PO_3H_2$, $—NH—CH_2—COOH$, or

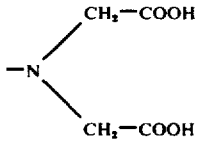

; and $n$ is one of the numerals 0 to 6.

3. The process of claim 1, wherein said additive further contains a compound selected from the group consisting of amino polycarboxylic acids, hydroxy carboxylic acids, and their alkali metal salts.

4. The process according to claim 1, in which the amount of additive is between about 0.04% and about 0.3%.

5. The process of claim 2, in which the amount of additive is between about 0.04% and about 0.3%.

6. The process of claim 1, in which the addition agent preventing formation of resinous deposits during processing is a mixture of diethylene tri-amino pentamethylene phosphonic acid and orthophosphoric acid.

7. The process of claim 1, in which the agent preventing formation of resinous deposits during processing is a mixture of ethylene diamino tetra-methylene phosphonic acid and orthophosphoric acid.

8. The process of claim 1, in which the alkali metal salts of the phosphonic acids are added during processing.

9. The process of claim 1, wherein said ratio is between about 1:4 and 4:1.

10. The process of claim 1, wherein said ratio is about 1:4.

* * * * *